United States Patent [19]

Stafford

[11] 4,384,017

[45] May 17, 1983

[54] WALLPAPER PREPARATION BOARD

[76] Inventor: William G. Stafford, 2584 Dublin Dr., Salt Lake City, Utah 84119

[21] Appl. No.: 283,166

[22] Filed: Jul. 14, 1981

Related U.S. Application Data

[63] Continuation-in-part of Ser. No. 214,125, Dec. 8, 1980, Pat. No. 4,340,161, which is a continuation of Ser. No. 49,738, Jun. 18, 1979, abandoned.

[51] Int. Cl.[3] ..... A47B 5/00; B25H 1/02

[52] U.S. Cl. ..... 428/12; 248/459; 428/52; 428/136; 428/904.4; 428/906

[58] Field of Search ..... 428/906, 8–9, 428/12, 52, 187, 134, 136; 225/18; 269/254 R; 248/459, 460

[56] References Cited

U.S. PATENT DOCUMENTS

| | | | |
|---|---|---|---|
| 491,488 | 2/1893 | Lundy | 225/18 |
| 526,038 | 9/1894 | Hoke | 225/18 X |
| 809,411 | 1/1906 | Von Auw | 269/254 R |
| 1,333,884 | 3/1920 | Usinger | 428/906 X |
| 1,520,284 | 12/1924 | Ellis | 428/136 |
| 1,695,766 | 12/1928 | Judd et al. | 225/18 |
| 2,043,133 | 6/1936 | Walter | 30/314 |
| 2,148,176 | 2/1939 | Schroeder | 428/906 X |
| 2,588,092 | 3/1952 | Duff | 269/254 R |
| 3,771,700 | 11/1973 | Garr | 225/77 X |
| 4,026,219 | 5/1977 | Shupe et al. | 108/62 |
| 4,340,161 | 7/1982 | Stafford | 225/18 |

FOREIGN PATENT DOCUMENTS

| | | | |
|---|---|---|---|
| 648510 | 1/1951 | United Kingdom | 225/18 |

*Primary Examiner*—Henry F. Epstein

*Attorney, Agent, or Firm*—Terry M. Crellin; B. Deon Criddle

[57] ABSTRACT

A wallpaper preparation board made of low cost rigid sheet material such as cardboard, paperboard, or thin sheets of wood, metal, or plastic, etc., is formed from a plurality of substantially flat panels of the sheet material which are hingedly attached end-to-end to form an elongate board which can be folded in accordion style into a compact unit. A first elongate opening is provided at one end of the board, with the opening being adapted to receive a roll of wallpaper longitudinally therein. A second elongate opening or slit is provided adjacent to the first opening, whereby the paper from the roll of wallpaper is directed under the portion of the board positioned between the two elongate openings and upwardly through the second elongate opening to be pulled along the length of the board. A cutting guide extends across the board next to the second elongate opening to aid in cutting lengths of wallpaper which are withdrawn from the roll. Wallpaper withdrawn from the roll is readily pasted and trimmed as it lays against the preparation board prior to its being cut from the roll.

5 Claims, 6 Drawing Figures

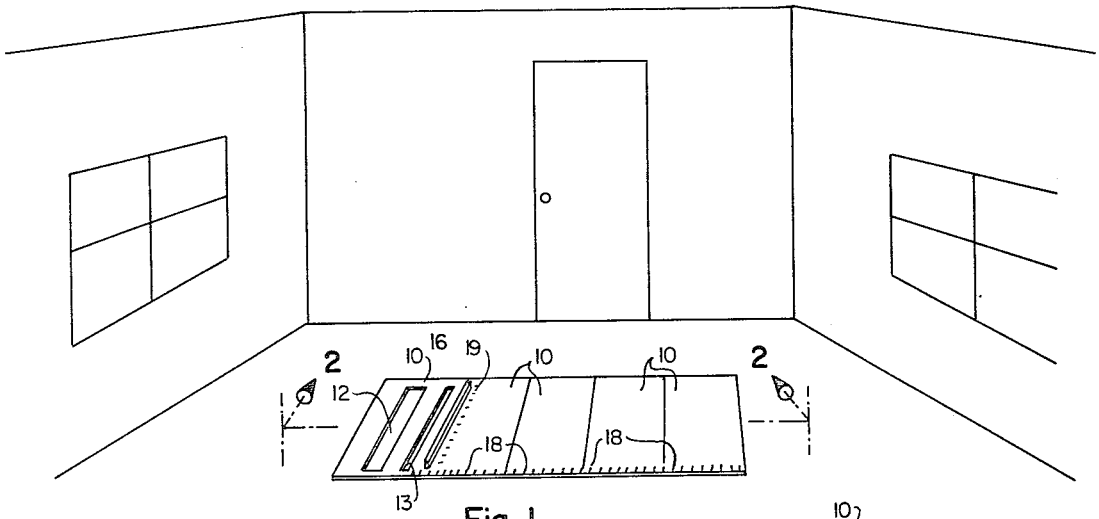
Fig. 1
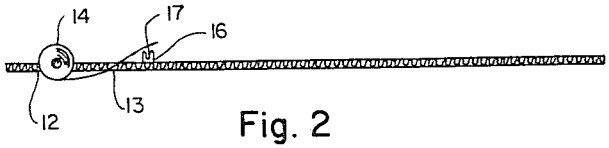
Fig. 2
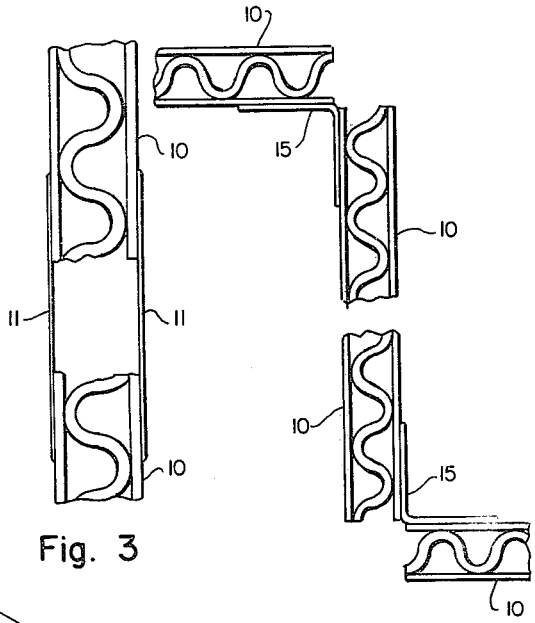
Fig. 3
Fig. 4
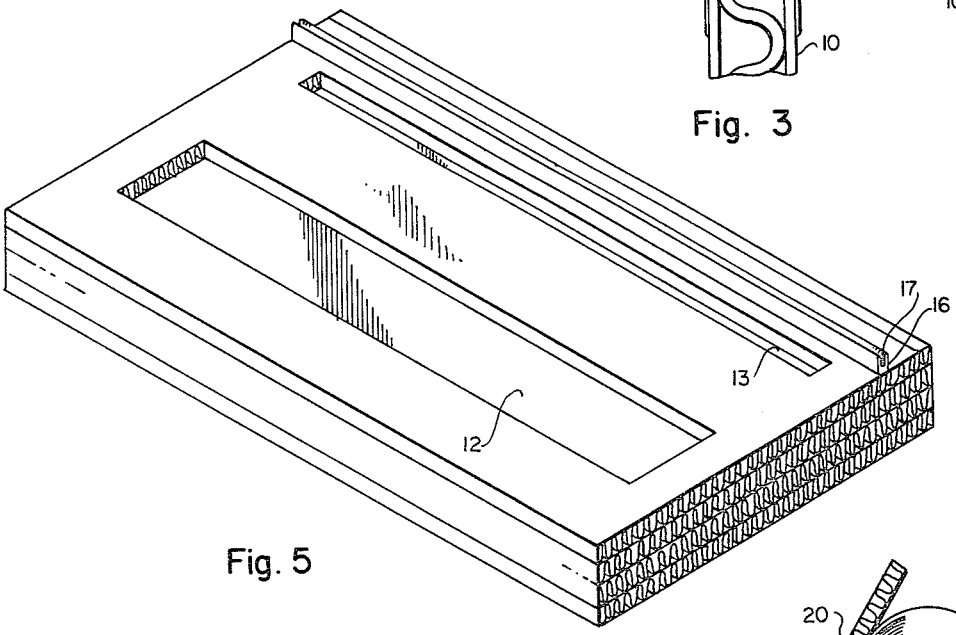
Fig. 5
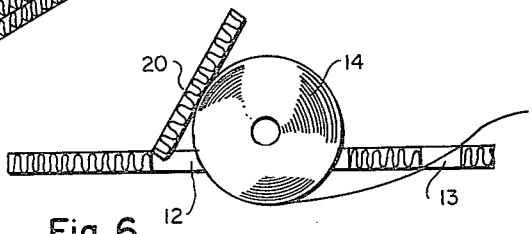
Fig. 6

WALLPAPER PREPARATION BOARD

RELATED APPLICATIONS

This application is a continuation in part of my copending application, Ser. No. 214,125 filed Dec. 8, 1980, which issued as U.S. Pat. No. 4,340,161. Application Ser. No. 214,125 was a continuation of application Ser. No. 49,738, filed June 18, 1979, which was abandoned.

BACKGROUND OF THE INVENTION

1. Field

The present invention pertains to methods and apparatus used in preparing lengths of wallpaper for application to a wall. In particular, the invention relates to apparatus for cutting particular lengths of wallpaper from a roll and applying paste to the backside of the lengths of wallpaper.

2. State of the Art

Various methods and apparatus have been suggested in the prior art for measuring, cutting, and pasting lengths of wallpaper prior to application of the lengths to a wall. Generally, the apparatus comprised different type tables upon which lengths of cut wallpaper were placed face down. Paste was applied to the backside of each strip, and when selvaged edges were common, means were provided for cutting the selvaged edge from the lengths of wallpaper. Examples of such apparatus for measuring and cutting wallpaper are shown in U.S. Pat. Nos. 491,488; 526,038; 1,695,766; 2,588,092; and 2,043,133.

OBJECTIVES

A principal objective of the present invention is to provide an inexpensive wallpaper preparation board which can be folded up along its length in accordion style folds so as to form a compact unit which is conveniently distributed in commerce, easily stored, and readily used by persons who are inexperienced as well as experienced in the art of hanging wallpaper.

SUMMARY OF THE INVENTION

The above objective is achieved in accordance with the present invention by providing an elongate, wallpaper preparation board comprising a plurality of substantially flat, rigid panels made of a sheet material such as cardboard, thin wood sheets, sheet metal, or sheets of plastic. The panels are hingedly attached in end-to-end relationship. The board can be folded in accordion style into a compact unit whose perimeter dimensions is substantially the same as the perimeter of the component panels.

A first elongate opening is provided at one end of the board. The length of the first opening is at least slightly longer than the length of a conventional roll of wallpaper, and the width of the first opening is such as to at least cradle a full roll of conventional wallpaper therein. A second elongate opening or slit is provided adjacent to the first opening, with the length of the second opening also being longer than the length of a conventional roll of wallpaper. Although the width of the second opening can be as large as that of the first opening, it is preferably somewhat narrower. The second opening need only be wide enough that the leading or loose end of the material on the roll of wallpaper or other wallcovering can be conventionally threaded upward through the second opening.

In using the preparation board in preparing lengths of wallpaper or other wallcovering for hanging, the board is laid out flat on a table, the floor, or other substantially flat support surface. A roll of wallpaper or other wallcovering is cradled in the first opening and the leading or loose end of the material on the roll is threaded under the portion of the board between the first and second openings and then upwardly through the second opening. The wallcovering is withdrawn from the roll of material through the second opening with the face of the withdrawn length of wallcovering positioned against the flat preparation board. Paste is applied to the exposed backside of the withdrawn length of material. The length of material is then cut from the roll near the second opening in the board. A cutting guide is provided to aid in cutting the length of material. The cutting guide is positioned extending across the board adjacent to the second opening. Indicia in the form of a ruler is provided along the length of the board on one side or both sides thereof to allow accurate measurement of the lengths of material as they are withdrawn from the roll. Repeated lengths of material are withdrawn from the roll by repeating the process. That is, the loose end of the material is pulled down the board from the second opening therein to the desired length. The length of material is pasted and cut from the roll, and a subsequent length of material is then pulled from the roll through the second opening.

The preparation board of the present invention makes the heretofor messy pasting of lengths of wallcovering material relatively simple and easy. The job of preparing the lengths of material for hanging becomes simple and easily handled which results in fewer pasting and other preparation mistakes.

Additional objects and features of the invention will become apparent from the following detailed description taken together with the accompanying drawings.

THE DRAWINGS

A preferred embodiment of the invention representing the best mode presently contemplated of carrying out the invention is illustrated in the accompanying drawings, in which:

FIG. 1 is a pictorial of the preparation board as it is laid out on a floor;

FIG. 2 is a cross-sectional view taken on the line 2—2 of FIG. 1 showing a roll of wallcovering material in working position on the board.

FIG. 3 is an enlarged fragmentary vertical view of the hinge connection between adjacent panels of the preparation board as shown at arrow 3 in FIG. 1;

FIG. 4 is an enlarged fragmentary view similar to FIG. 3 but showing a second preferred embodiment of a hinge connection between adjacent panels of the preparation board;

FIG. 5 is a pictorial of the preparation board of FIG. 1 showing the board in its folded position; and FIG. 6 is a partial cross-sectional view through an alternate embodiment of the board of the present invention in which a tab is provided to aid in retaining the roll of wallcovering in its working position on the board.

DETAILED DESCRIPTION OF THE ILLUSTRATED EMBODIMENT

Referring to the drawings, a wallpaper preparation board in accordance with this invention is shown comprising a plurality of substantially flat, rigid panels 10 made of a sheet material such as double sided corrugated cardboard. The panels 10 are hingedly attached end-to-end so that adjoining panels can be folded over each other. In one preferred embodiment, as shown in FIG. 3, the adjoining panels 10 are spaced slightly from each other and connected together by strips of tape 11 extending across the gap between the adjacent panels 10 holding the panels together. In order for the panels 10 to be adapted to fold back or forward over each other, the space between the adjoining ends of the panels 10 is at least the combined thickness of the two panels 10 which are connected together. The panels 10 can be made of other rigid sheet materials such as thin sheets of plastic, metal, and wood. The plastic, metal, or wood panels can be hingedly connected together using strips of tape in a manner similar to that shown in the drawings. In a second preferred embodiment, as shown in FIG. 4, the panels 10 are made of corrugated cardboard and are attached together using common hinge members. Generally, the common hinge members such as the strip of tape 15 (this could also be the uncut side of the corrugated cardboard, one side being cut along the hinge and the other non-cut side forming the active hinge) will allow adjacent panels to be folded over each other in only one direction, and to provide for accordion type folding of the panels, the hinges on adjacent joints must be placed on opposite sides of the board.

As mentioned above, the panels 10 are attached in end-to-end relationship in such manner that the series of panels 10 forming the elongate board can be folded in accordion style into a compact unit as shown in FIG. 5. In folding the elongate board, the lowermost panel is folded in either direction so as to lie flat against the surface of the adjoining panel. The two side-by-side panels are then folded as a unit in the opposite direction from that in which the lowermost panel was folded so that the two side-by-side panels lie flat against the surface of the next adjoining panel. Folding is continued in a similar manner with faces of adjacent panels lying face-to-face in the folded unit. As shown in FIG. 5, the unit has an outer perimeter substantially the same as that of one of the component panels 10.

In the preferred embodiment shown in the drawings, the end panel which is to support the roll of wallcovering material is provided with a first elongate opening 12 extending generally transverse of the board. The opening 12 is located adjacent to the one end of the preparation board (this end to be hereinafter referred to as the upper or top end). The length of the elongate opening 12 is at least equal to the length of a conventional roll of wallcovering material. Preferably, of course, the length of the elongate opening 12 is slightly greater than the length of the roll of wallcovering material. The width of the preparation board is, of course, several inches wider than the length of the elongate opening 12, so that the opening 12 does not extend from edge to edge of the preparation board. The width of the elongate opening 12 is not critical per se. The opening 12 should be wide enough to at least cradle the roll of wallcovering. The opening 12 is preferably about two inches or greater in width but need not be over about three to four inches in width. Although greater widths can be used for the opening 12 they simply become impractical.

A second elongate opening 13 is provided adjacent to the first opening 12 so as to generally be parallel with the first opening. The second opening 13 is spaced from the first opening 12, and although the spacing is not critical, the space between the openings is advantageously between about one and three inches. The length of the second opening 13 is at least as long as the length of conventional rolls of wallcovering material, and preferably about the same length the first opening 12. The width of the second opening 13 is generally less than the width of opening 12 and need only be wide enough to allow feeding the free end of the roll of wallcovering material therethrough. Advantageously, the width of the second opening 13 is about one-half to one inch.

FIG. 2 of the drawings shows a roll 14 of wallcovering material in working position on the preparation board in accordance with the invention. The roll 14 of wallcovering material is cradled in the first opening 12, and the free or loose end of the material on the roll 14 is directed beneath the portion of the preparation board between the first and second openings 12 and 13 and then upwardly through the second opening 13. When the roll 14 of wallcovering material is positioned on the preparation board and the loose end of the material is fed through the second opening 13 as shown in FIG. 2, lengths of wallpaper can be withdrawn from the roll 14 and pulled along the preparation board. The roll 14 is held in place in the first opening 12 and allowed to unroll as the length of material is pulled along the preparation board.

A straightedge or other cutting guide is provided at one end of the preparation board for cutting the withdrawn lengths of wallpaper from the roll 14. As shown in FIGS. 2 and 5, a cutting guide 16 extends across the preparation board near the second opening 13. Preferably, the cutting guide 16 is located adjacent to the second opening 13. The cutting guide 16 is advantageously made of extruded plastic and has a channel 17 formed therein which extends longitudinally along the cutting guide 16. The channel 17 forms a convenient guide for directing a knife across the sheet of wallcovering material.

Indicia 18 is placed along the length of the board for measuring the length of wallcovering material which is withdrawn from the roll 14. As shown in FIG. 1, the indicia 18 marks off feet and inches along one side of the board. The indicia 18 could be marked on both sides of the board if so desired as well as along a line down the center of the board. Additional indicia 19 (FIG. 1) can be provided across the width of the board, preferably adjacent to the cutting guide 16. The cross board indicia 19 is useful in cutting the length of wallpaper into strips which are not as wide as the wallpaper on the roll 14.

The width of the preparation board is somewhat larger than the widths of conventional wallcovering materials. Preferably, the preparation board has a width of between about 30 inches and about 36 inches.

In a second preferred embodiment of the preparation board as illustrated in FIG. 6, the first elongate opening 12 has an elongate generally rectangular tab 20 hingedly attached to the longitudinal side thereof which is next to the end of the preparation board. Thus, the tab 20 extends upwardly from the longitudinal side edge of the first opening 12 so that the opening 12 is between the tab 20 and the second opening 13. The tab 20 is preferably formed by cutting the panel 10 along the sides of the intended opening and along the longitudinal side edge of the intended opening furthest from the upper or top end of the preparation board. The portion of the panel 10 encompassed by these cuts is bent upwardly so that the bend line forms the longitudinal side edge of opening 12 closest to the upper or top end of the preparation board. When the panel 10 is made of double sided corrugated cardboard, the lower side of the cardboard is preferably cut, as shown in FIG. 6, along the bend line, so that the upper side of the cardboard forms an integral, live hinge for the tab 20. The tab 20 will generally make an acute angle with respect to the opening 12. The width of the opening can be such that a roll 14 of wallcovering material will fit entirely in the opening as shown in FIG. 6, or the opening 12 can be somewhat narrower such that the roll 14 will be cradled in the opening 12. In either situation the roll 14 is held in place by the tab 20 for rotational movement and restrained from translational movement towards the upper or top end of the preparation board when the end of the material is withdrawn from the roll through the second opening 13.

With the preparation board as shown and described, lengths of wallpaper are readily pulled from the roll 14. The length of withdrawn wallpaper lies face down against the preparation board. Pasting of the exposed backside of the length of wallpaper is easily and readily accomplished, as are other preparations such as trimming the length of wallpaper to desired size. The length of wallpaper is then cut from the roll 21 and is ready for being applied to a wall.

Although two preferred embodiments of the invention have been illustrated and described, it is to be understood that various variations are possible without departing from the subject matter coming within the scope of the following claims, which subject matter is regarded as the invention.

I claim:

1. A wallpaper preparation board comprising a plurality of substantially flat, rigid panels of sheet material, said panels being hingedly attached end-to-end to form an elongate preparation board which can be folded in accordion style into a compact unit;

a first, elongate opening near one end of the board with the longitudinal direction of the first opening being generally transverse of the length of the preparation board, said first opening being adapted to receive a roll of wallcovering material longitudinally therein so that said roll is at least cradled within said first opening;

a second elongate opening or slit in said board near said first opening, said second opening being generally parallel with and adjacent to said first opening, whereby the material on said roll can be threaded under the board from said first opening and upwardly through said second opening and then pulled along the length of said preparation board.

2. A wallpaper preparation board in accordance with claim 1, wherein an elongate flap is attached to said preparation board so as to extend upwardly from the longitudinal edge of said first opening nearest said one end of said preparation board.

3. A wallpaper preparation board in accordance with claim 2, wherein the flap is hingedly attached to said preparation board.

4. A wallpaper preparation board in accordance with claim 3, wherein the flap is formed by the material which is otherwise cut from said board to make said first opening with the ends and opposite sides of said opening being cut in said board and the cut portion bent upwardly thereby forming said flap.

5. A wallpaper preparation board in accordance with any one of claims 1–4 wherein the panels are made of cardboard.

* * * * *